US007987826B2

(12) United States Patent
Kwak et al.

(10) Patent No.: US 7,987,826 B2
(45) Date of Patent: Aug. 2, 2011

(54) VARIABLE VALVE LIFT APPARATUS

(75) Inventors: Young Hong Kwak, Suwon (KR); Kiyoung Kwon, Seoul (KR); Ki Uk Shin, Hwaseong (KR); Jin Kook Kong, Suwon (KR)

(73) Assignee: Hyundai Motor Company, Seoul (KR)

( * ) Notice: Subject to any disclaimer, the term of this patent is extended or adjusted under 35 U.S.C. 154(b) by 554 days.

(21) Appl. No.: 12/145,144

(22) Filed: Jun. 24, 2008

(65) Prior Publication Data

US 2009/0151682 A1 Jun. 18, 2009

(30) Foreign Application Priority Data

Dec. 14, 2007 (KR) ..... 10-2007-0131565

(51) Int. Cl.
*F01L 1/34* (2006.01)

(52) U.S. Cl. ..... 123/90.16; 123/90.48

(58) Field of Classification Search ..... 123/90.5, 123/90.16, 90.48, 90.55, 90.56, 90.57, 90.32, 123/90.35, 90.58, 90.59
See application file for complete search history.

(56) References Cited

U.S. PATENT DOCUMENTS

| | | | | |
|---|---|---|---|---|
| 5,343,833 | A * | 9/1994 | Shirai | 123/90.16 |
| 5,743,226 | A * | 4/1998 | Tohdoh et al. | 123/90.16 |
| 6,213,076 | B1 * | 4/2001 | Fischer et al. | 123/90.55 |
| 6,273,041 | B1 * | 8/2001 | Haas et al. | 123/90.16 |
| 6,397,804 | B1 * | 6/2002 | Harada et al. | 123/90.16 |
| 2009/0056659 | A1 * | 3/2009 | Nagado et al. | 123/90.48 |

FOREIGN PATENT DOCUMENTS

| | | | |
|---|---|---|---|
| JP | 2002-106313 | A | 4/2002 |
| JP | 2002106313 | A * | 4/2002 |

* cited by examiner

*Primary Examiner* — Thomas E Denion
*Assistant Examiner* — Daniel A Bernstein
(74) *Attorney, Agent, or Firm* — Morgan, Lewis & Bockius LLP

(57) ABSTRACT

A variable valve lift apparatus according to an exemplary embodiment of the present invention includes a low lift cam, a high lift cam in parallel with the low lift cam, a low lift tappet body that selectively contacts the low lift cam, a high lift tappet body disposed within the low lift tappet body and constantly contacting the high lift cam, a guide portion that is connected with a valve and selectively connects the low lift tappet body and the high lift tappet body, and a lost motion spring that is disposed between the guide portion and the low lift tappet body and supplies restoring force to the low lift tappet body.

6 Claims, 6 Drawing Sheets

(a)

(b)

VARIABLE VALVE LIFT APPARATUS

CROSS-REFERENCE TO RELATED APPLICATION

This application claims priority to and the benefit of Korean Patent Application No. 10-2007-0131565 filed in the Korean Intellectual Property Office on Dec. 14, 2007, the entire contents of which are incorporated herein by reference.

BACKGROUND OF THE INVENTION (a) Field of the Invention

The present invention relates to a variable valve lift apparatus. More particularly, the present invention relates to a variable valve lift apparatus that may realize a cylinder deactivation function with a simple structure.

(b) Description of the Related Art

A typical combustion chamber of an automotive engine is provided with an intake valve for supplying an air/fuel mixture and an exhaust valve for expelling burned gas. The intake and exhaust valves are opened and closed by a valve lift apparatus connected to a crankshaft.

A conventional valve lift apparatus has a fixed valve lift amount due to a fixed cam shape. Therefore, it is impossible to adjust the amount of a gas that is being introduced or exhausted.

If the valve lift apparatus is designed for low driving speeds, the valve open time and amount are not sufficient for high speeds. On the other hand, if the valve lift apparatus is designed for high speeds, the opposite is true.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments of the present invention provide a variable valve lift apparatus that may realize a high lift mode and a low lift mode according to an operation condition of a vehicle, which may reduce manufacturing cost with a simple structure.

According to an exemplary embodiment of the present invention, a variable valve lift apparatus comprising: a low lift cam, a high lift cam disposed co-axially and in parallel with the low lift cam, a low lift tappet body selectively contacting the low lift cam, a high lift tappet body disposed within the low lift tappet body and constantly contacting the high lift cam, a guide portion that is connected with a valve and selectively connects the low lift tappet body and the high lift tappet body; and a lost motion spring that is disposed between the guide portion and the low lift tappet body, and supplies restoring force to the low lift tappet body.

The high lift tappet body may comprise a vertical column to which an operating pin insertion hole is formed, the guide portion comprises an operating pin guide to which a vertical guide channel and a horizontal guide channel arc formed, an operating pin includes an operating pin inserting portion, wherein the operating pin is disposed to the horizontal guide channel, the vertical column is inserted into the vertical guide channel, and the operating pin inserting portion is selectively inserted into the operating pin insertion hole.

A hydraulic pressure supplying hole may be formed to the low lift tappet body, and hydraulic pressure is supplied to the operating pin through the hydraulic pressure supplying hole and the horizontal guide channel.

A return spring for supplying restoring force to the operating pin and a stopper for supporting the return spring may be disposed to the horizontal guide channel. The low lift tappet body and the operating pin guide may be connected by a locking pin. A locking pin guide hole may be formed to the high lift tappet body and a distal end portion of the locking pin extends through the locking pin guide hole for guiding the locking pin.

According to another exemplary embodiment of the present invention, a variable valve lift apparatus comprising: at least a low lift cam, a high lift cam disposed co-axially and in parallel with the low lift cam, at least a low lift tappet body selectively contacting the low lift cam, wherein the at least a low lift tappet body are connected by at least a connecting bracket, a high lift tappet body disposed between the at least a low lift tappet body and constantly contacting the high lift cam, a guide portion connected with a valve and selectively connecting the low lift tappet body and the high lift tappet body; and a lost motion spring that is disposed between the guide portion and the low and high lilt tappet bodies, and supplies restoring force to the low lift tappet body in a low life mode.

The high lift tappet body may comprise a vertical column to which an operating pin insertion hole is formed, the guide portion comprises an operating pin guide to which a vertical guide channel and a horizontal guide channel are formed, wherein the vertical guide channel is disposed in a longitudinal direction of the vertical column of the high lift tappet body and a portion of the vertical column is inserted into the vertical guide channel and the horizontal guide channel is disposed substantially perpendicular to the vertical guide channel, an operating pin having an operating pin inserting portion, wherein the operating pin is disposed in the horizontal guide channel; and the operating pin inserting portion is selectively inserted into the operating pin insertion hole.

The operating pin may comprise a guide portion, a blocking portion and an operating pin insertion portion disposed between the guide portion and the blocking portion. The blocking portion may prevent the vertical column of the high lift tappet body in high lift mode and the operating pin insertion portion reciprocates in the operating pin insertion hole in low lift mode. A hydraulic pressure supplying hole is formed to the low lift tappet body, and hydraulic pressure is supplied to the operating pin through the hydraulic pressure supplying hole and the horizontal guide channel. A return spring for supplying restoring force to the operating pin and a stopper for supporting the return spring may be disposed in the horizontal guide between the operating pin and the stopper. The connecting bracket of the low lift tappet body and the operating pin guide may be connected by a locking pin. A locking pin guide hole may be formed on a lateral surface thereof and a distal end portion of the locking pin may be slidably coupled to the locking pin guide hole of the high lift tappet body for guiding the locking pin.

A variable valve lift apparatus according to an exemplary embodiment of the present invention may reduce manufacturing cost with a simple structure.

REPRESENTATIVE REFERENCE NUMERALS

Figure 1:
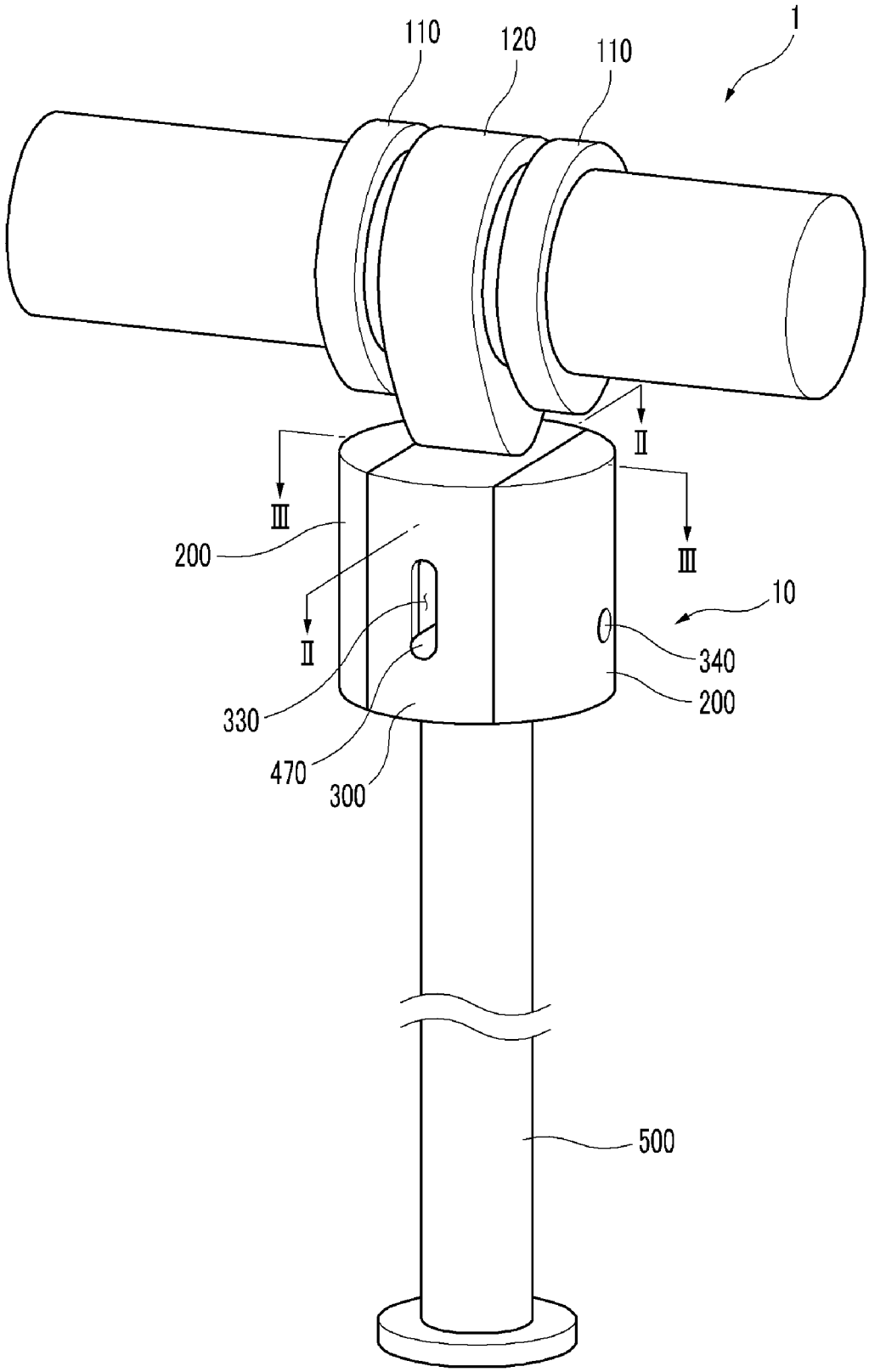
FIG. 1 is a perspective view of a variable valve lift apparatus according to an exemplary embodiment of the present invention.

1: variable valve lift apparatus
10: tappet body
110: low lift cam
120: high lift cam
200: low lift tappet body
300: high lift tappet body
310: vertical column
320: operating pin insertion hole
330: locking pin guide hole
340: hydraulic pressure supplying hole
400: guide portion
410: operating pin guide
420: vertical guide channel
430: horizontal guide
440: operating pin
445: operating pin inserting portion
450: return spring
460: stopper
470: locking pin
480: lost motion spring
500: valve

DETAILED DESCRIPTION OF THE EMBODIMENTS

An exemplary embodiment of the present invention will hereinafter be described in detail with reference to the accompanying drawings.

Figure 2:
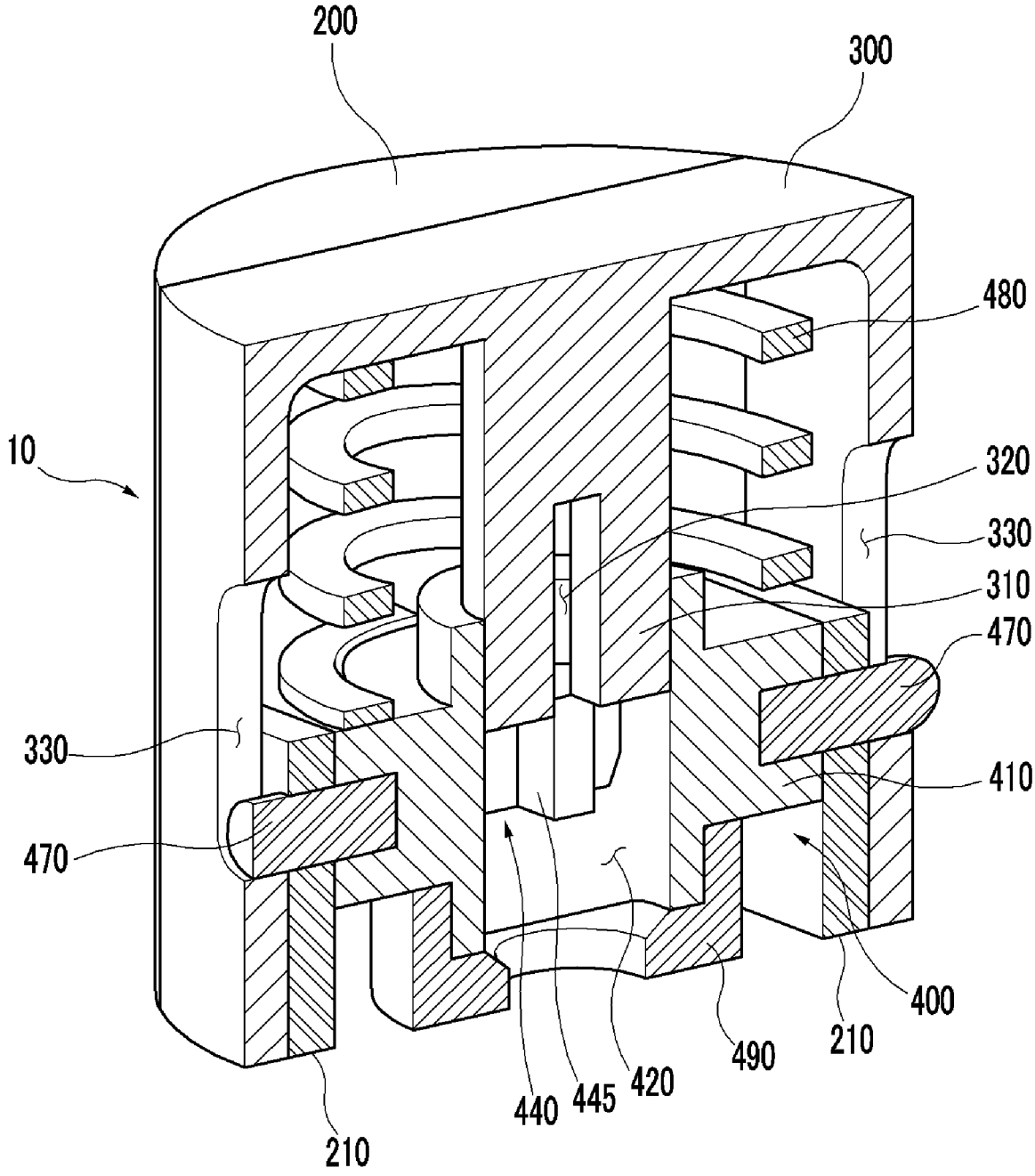
FIG. 2 is a cross-sectional view along a line II-II in FIG. 1.
Figure 3:
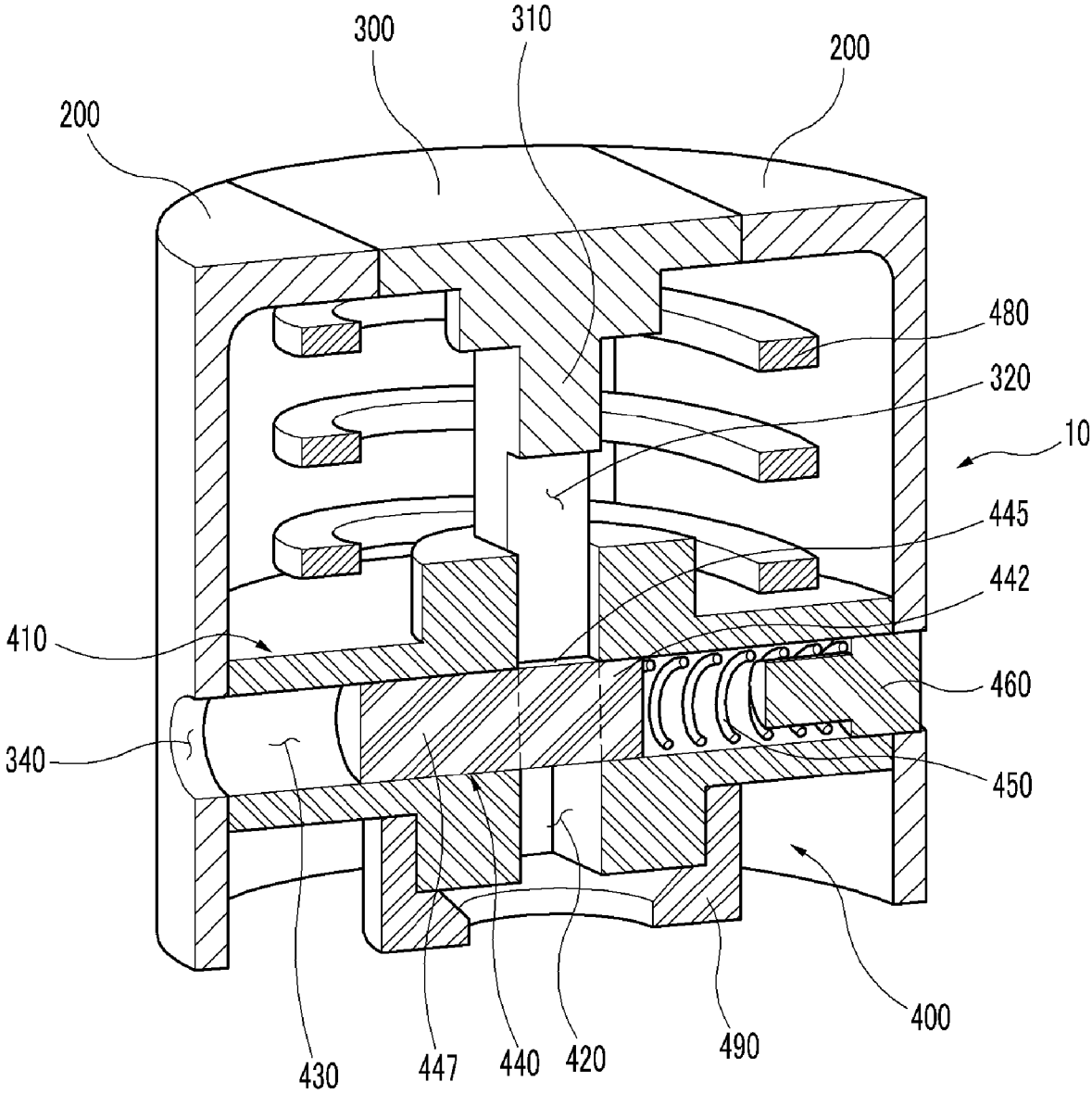
FIG. 3 is a cross-sectional view along a line III-III in FIG. 1.

Referring to FIG. 1 to FIG. 3, a variable valve lift apparatus 1 according to an exemplary embodiment of the present invention includes at least a low lift cam 110, a high lift cam 120 disposed in parallel with the low lift cam 110, and a tappet body 10. Preferably, the high lift cam 120 is disposed between two low lift cams 110.

The tappet body 10 includes a low lift tappet body 200 that selectively contacts the low lift cam 110, and a high lift tappet body 300 that is disposed between the low lift tappet bodies 200 and constantly contacts the high lift cam 120.

The variable valve lift apparatus 1 includes a guide portion 400 that is connected with a valve 500 via a mounting bracket 490 and selectively connects the low lift tappet body 200 with the high lift tappet body 300, and a lost motion spring 480 that is disposed between the guide portion 400 and the tappet body 10 and supplies restoring force to the low lift tappet body 200.

Referring to FIG. 3, the high lift tappet body 300 includes a vertical column 310 in which an operating pin insertion hole 320 is formed, and the guide portion 400 includes an operating pin guide 410 in which a vertical guide channel 420 and a horizontal guide channel 430 are formed. The vertical guide channel 420 is formed in the longitudinal direction of the high lift tappet body 300 and the horizontal guide channel 430 is formed perpendicular to the vertical guide channel 420.

Figure 5:
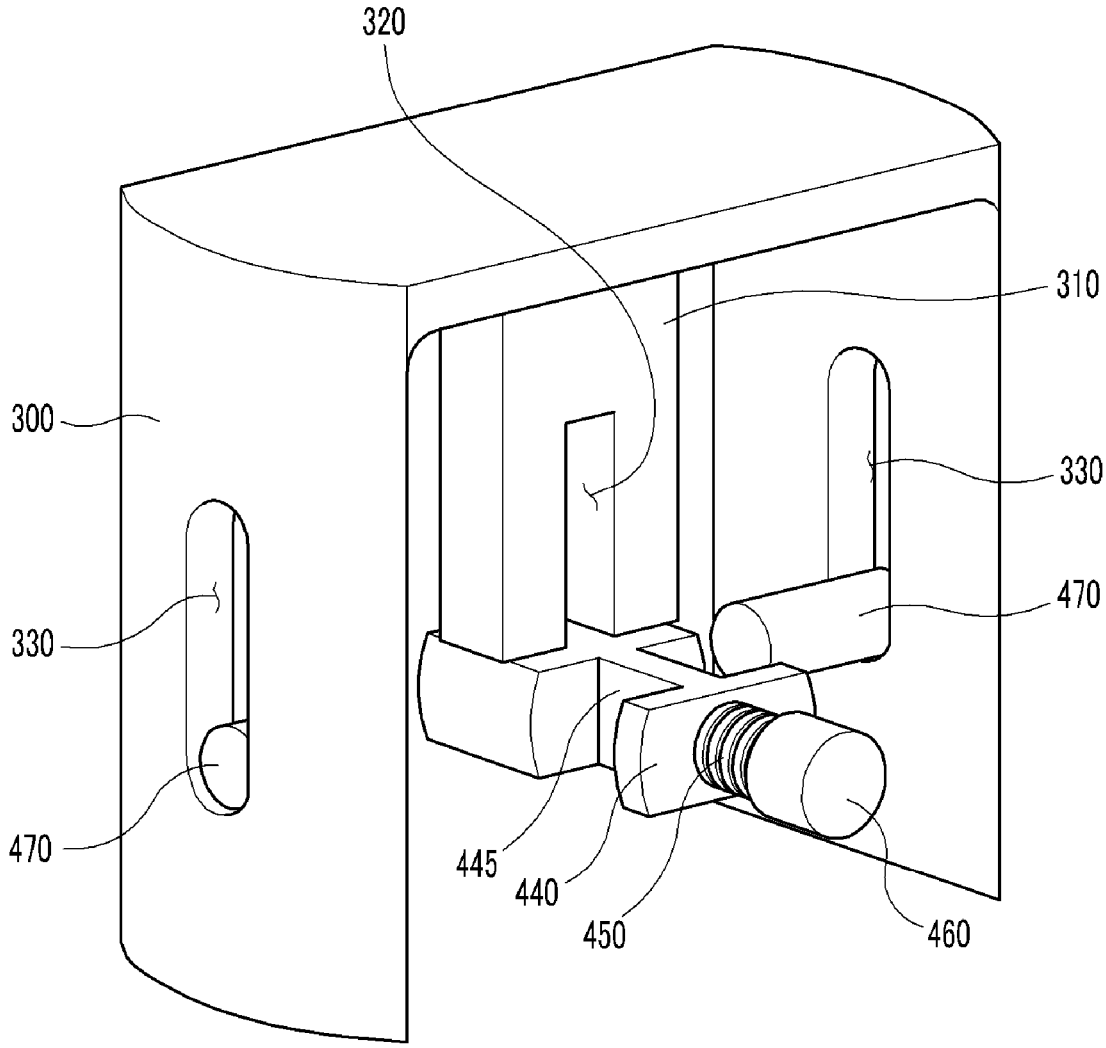
FIGS. 5(*a*) and (*b*) are views showing a low lift tappet body and an operating pin of the variable valve lift apparatus according to an exemplary embodiment of the present invention respectively in a high lift mode.
Figure 5:
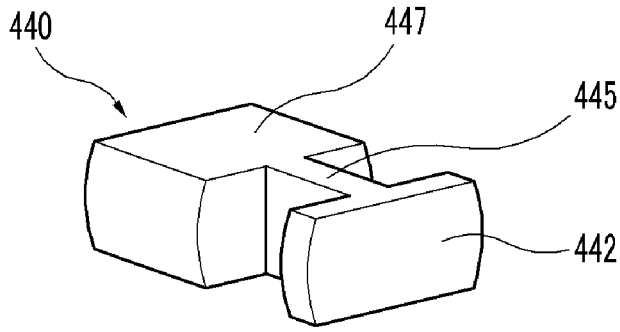

Referring to FIG. 2 and FIGS. 5(*a*) and (*b*), an operating pin 440 with an operating pin inserting portion 445 formed thereto is disposed in the horizontal guide channel 430, the vertical column 310 of the high lift tappet body 300 is slidably inserted into the vertical guide channel 420, and an operating pin inserting portion 445 of the operating pin 440 may be selectively inserted into the operating pin insertion hole 320 according to mode changes of high or low lift mode.

The operating pin 440 comprises a front guide portion 442, a blocking portion 447, and an operating pin insertion portion 445 disposed between the front guide portion 442 and the blocking portion 447. In an exemplary embodiment of the present invention, the width and height of the front guide portion 442 and the blocking portion 447 are the same but the operating pin insertion portion 445 are thinner than the front guide portion 442 and the blocking portion 447 such that the operating pin insertion portion 445 can be engaged in the operating pin insertion hole 320 in low lift mode as explained later.

Referring to FIG. 3, a hydraulic pressure supplying hole 340 is formed to a lower portion of the low lift tappet body 200 and aligned with the horizontal guide channel 430 for fluid communication, and thus hydraulic pressure is supplied to the operating pin 440 through the hydraulic pressure supplying hole 340 and the horizontal guide channel 430.

A stopper 460 is disposed at the other end of the horizontal guide channel 430.

A return spring 450 supplying restoring force to the operating pin 440 and the stopper 460 supporting the return spring 450 are disposed between the operating pin 440 and the stopper 460 in the horizontal guide channel 430.

Referring to FIG. 2, a connecting bracket 210 extends from a lower portion of the low lift tappet body 200 through the high lift tappet body 300. As a result, the low lift tappet body 200 is connected each other via the connecting bracket 210 inside the high lift tappet body 300 and thus the high lift tappet body 300 is slidable on the connecting bracket 210 as explained the next.

The connecting bracket 210 of the low lift tappet body 200 is connected with the operating pin guide 410 of the guide portion 400 by a locking pin 470.

A locking pin guide hole 330 is formed on a lateral portion of the high lift tappet body 300 and a distal end portion of the locking pin 470 is slidably coupled to the locking pin guide hole 330 for guiding the locking pin 470.

Hereinafter, operation of high lift mode and low lift mode according to an exemplary embodiment of the present invention will be explained in detail.

FIG. 1 and FIG. 5 illustrate a high lift mode of the variable valve lift 1.

Referring to FIG. 1, in a high lift mode of the variable valve lift apparatus 1 according to an exemplary embodiment of the present invention, hydraulic pressure is supplied to the operating pin 440 through the hydraulic pressure supplying hole 340.

Accordingly, as shown in FIG. 5, as hydraulic pressure is supplied to the operating pin 440 through the hydraulic pressure supplying hole 340, the operating pin 440 moves forward so that the blocking portion 447 of the operating pin 440 prevents the vertical column 310 of the high lift tappet body 300 from reciprocating along the vertical guide channel 420 of the guide portion 400. From this operation, the return spring 450 is compressed as shown in FIG. 5. As a result, the high lift cam 120 opens and closes the valve 500 by the vertical column 310 of the high lift tappet body 300 and the operating pin 440, wherein the high lift tappet body 300 and the low lift tappet body 200 integrally moves.

Figure 4:
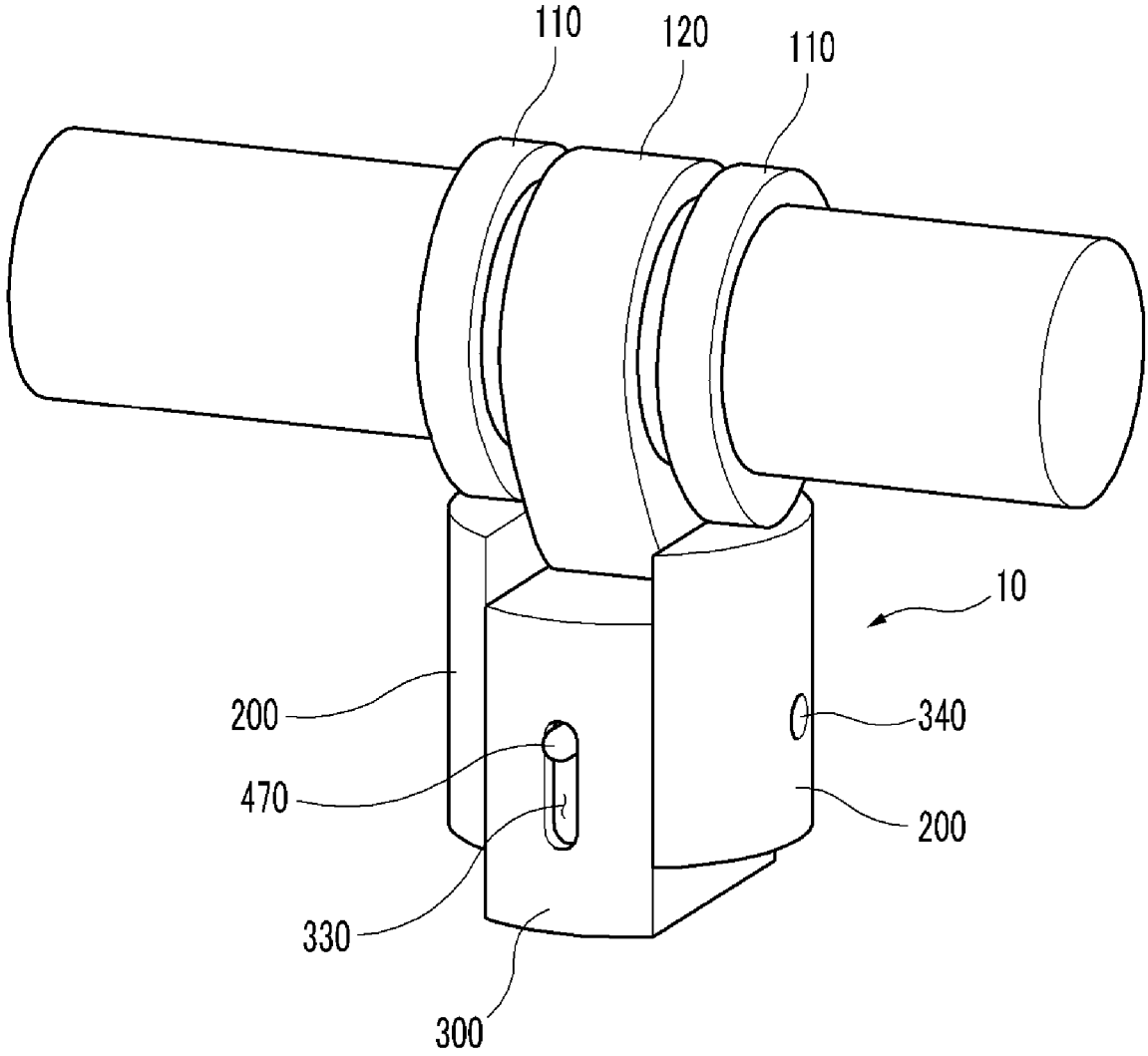
FIG. 4 is a view showing an operation of the variable valve lift apparatus according to an exemplary embodiment of the present invention in a low lift mode.
Figure 6:
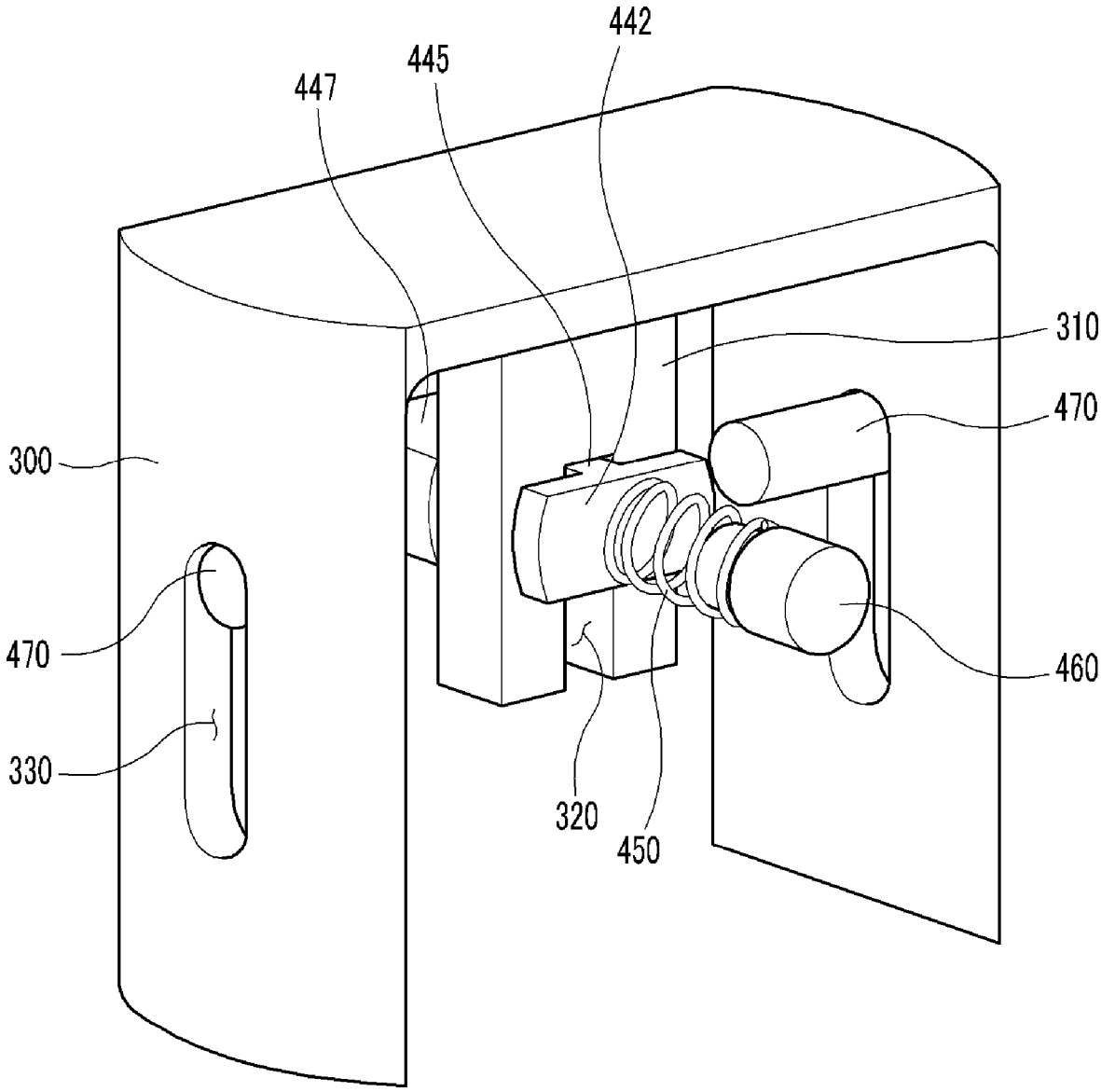
FIG. 6 is a view showing an operation of a low lift tappet body of the variable valve lift apparatus according to an exemplary embodiment of the present invention in a low lift mode.

Referring to FIGS. 3, 4 and 6, a low lift mode of the variable valve lift apparatus 1 according to an exemplary embodiment of the present invention will be explained.

In a low lift mode of the variable valve lift apparatus 1 according to an exemplary embodiment of the present invention, hydraulic pressure is not supplied to the operating pin 440.

Since the hydraulic pressure is not supplied to the operating pin 440, as shown in FIG. 6, the return spring 450 supplies a restoring force to the operating pin 440 and thus the operating pin 440 moves backwards as shown in FIG. 6. Referring to FIG. 3, when the operating pin insertion portion 445 corresponds to the operating pin insertion hole 320 of the vertical column 310, the vertical column 310 reciprocates up and down according to the rotation of the high lift cam 120 with support of lost motion spring 480. That is, the operating pin inserting portion 445 is inserted into the operating pin insertion hole 320 of the vertical column 310 so that lost motion occurs. Thus, as shown in FIG. 4, the low lift cam 110 opens or closes the valve 500 as the high lift tappet body 300 moves along the locking pin guide hole 330 separately from the low lift tappet body 200.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A variable valve lift apparatus comprising:

at least a low lift cam;

a high lift cam disposed co-axially and in parallel with the low lift cam;

at least a low lift tappet body selectively contacting the low lift cam, wherein the at least a low lift tappet body are connected by at least a connecting bracket;

a high lift tappet body disposed between the at least a low lift tappet body and constantly contacting the high lift cam;

a guide portion connected with a valve and selectively connecting the low lift tappet body and the high lift tappet body; and a lost motion spring that is disposed between the guide portion and the low and high lift tappet bodies, and supplies restoring force to the low lift tappet body in a low life mode, wherein:

the high lift tappet body comprises a vertical column to which an operating pin insertion hole is formed;

the guide portion comprises an operating pin guide to which a vertical guide channel and a horizontal guide channel are formed, wherein the vertical guide channel is disposed in a longitudinal direction of the vertical column of the high lift tappet body and a portion of the vertical column is inserted into the vertical guide channel and the horizontal guide channel is disposed substantially perpendicular to the vertical guide channel;

an operating pin having an operating pin inserting portion, wherein the operating pin is disposed in the horizontal guide channel; and the operating pin inserting portion is selectively inserted into the operating pin insertion hole, and wherein the operating pin comprises a guide portion, a blocking portion and an operating pin insertion portion disposed between the guide portion and the blocking portion.

2. The variable valve lift apparatus of claim 1, wherein the blocking portion prevents the vertical column of the high lift tappet body in high lift mode and the operating pin insertion portion reciprocates in the operating pin insertion hole in low lift mode.

3. The variable valve lift apparatus of claim 1, wherein a hydraulic pressure supplying hole is formed to the low lift tappet body, and hydraulic pressure is supplied to the operating pin through the hydraulic pressure supplying hole and the horizontal guide channel.

4. The variable valve lift apparatus of claim 3, wherein a return spring for supplying restoring force to the operating pin and a stopper for supporting the return spring is disposed in the horizontal guide between the operating pin and the stopper.

5. The variable valve lift apparatus of claim 4, wherein the connecting bracket of the low lift tappet body and the operating pin guide are connected by a locking pin.

6. The variable valve lift apparatus of claim 5, wherein a locking pin guide hole is formed on a lateral surface thereof and a distal end portion of the locking pin is slidably coupled to the locking pin guide hole of the high lift tappet body for guiding the locking pin.

* * * * *